US006945363B2

(12) United States Patent
Angst et al.

(10) Patent No.: US 6,945,363 B2
(45) Date of Patent: Sep. 20, 2005

(54) METHOD OF CONTACTLESSLY MONITORING ELEVATOR SHAFT DOORS

(75) Inventors: Philipp Angst, Zug (CH); Urs Baumgartner, Merenschwand (CH)

(73) Assignee: Inventio AG, Hergiswil (CH)

( * ) Notice: Subject to any disclaimer, the term of this patent is extended or adjusted under 35 U.S.C. 154(b) by 179 days.

(21) Appl. No.: 10/428,602

(22) Filed: May 2, 2003

(65) Prior Publication Data

US 2004/0007429 A1 Jan. 15, 2004

(30) Foreign Application Priority Data

May 3, 2002 (EP) ..... 02405360

(51) Int. Cl.[7] ..... B66B 13/26

(52) U.S. Cl. ..... 187/317; 187/300; 187/301; 187/303

(58) Field of Search ..... 187/300, 301, 187/303, 316, 317, 391, 393; 49/26, 28

(56) References Cited

U.S. PATENT DOCUMENTS 5,476,157 A * 12/1995 Todaro ..... 187/280
5,616,895 A 4/1997 Spiess
5,644,111 A 7/1997 Cerny et al.
5,712,458 A * 1/1998 McCandless et al. ..... 187/317
6,382,362 B1 * 5/2002 Kutz ..... 187/316
6,443,265 B1 * 9/2002 Nakamori et al. ..... 187/317
6,467,585 B1 * 10/2002 Gozzo et al. ..... 187/391
6,550,585 B2 * 4/2003 Schoppa et al. ..... 187/391
6,591,947 B2 * 7/2003 Horbrügger et al. ..... 187/393
6,603,398 B2 * 8/2003 Tinone et al. ..... 340/541
6,626,268 B1 * 9/2003 Masuda et al. ..... 187/317
6,732,839 B2 * 5/2004 Schuster ..... 187/391

FOREIGN PATENT DOCUMENTS

EP 0897892 A2 * 2/1999 ..... B66B/13/22
FR 2775272 8/1999

* cited by examiner

*Primary Examiner*—Jonathan Salata
(74) *Attorney, Agent, or Firm*—Buizel Long

(57) ABSTRACT

A method for monitoring shaft doors of a elevator installation uses at least one contactlessly acting shaft door monitoring sensor to emit a beam of electromagnetic waves, wherein at least during specific detection phases the beam extends over several floors and is detected by a receiver. The beam is influenced by a shaft door panel not being completely closed and/or a shaft door lock not being disposed in the locking setting such that a disturbance signal is generated to the elevator control.

18 Claims, 6 Drawing Sheets

Fig. 9 (View F)

METHOD OF CONTACTLESSLY MONITORING ELEVATOR SHAFT DOORS

BACKGROUND OF THE INVENTION

The present invention relates generally to a method for monitoring shaft doors of an elevator installation.

Elevator installations usually include shaft doors that in closed state separate, on each floor, the elevator shaft from the adjoining spaces. In the case of elevator installations of the conventional kind, the load receiving means (elevator car) is also equipped with a door, which is termed a car door and which moves together with the elevator car from floor to floor. The opening and closing of the car doors is normally effected, during stopping of the elevator car at a floor, by a car door drive controlled by an elevator control. In that case the car door panels are coupled with the respectively corresponding shaft door panels so that the shaft door panels accompany the movement of the car door panels.

For the safety of users of the elevator installation and passers-by in the building it is of great importance that a shaft door should be open only if the elevator car stops at the associated floor. In order to ensure this, there is monitored, apart from other elevator parameters, the positions not only of the shaft door panels, but also of the shaft door locks locking the shaft door panels. This usually takes place in such a manner that each shaft door lock is associated with a safety contact which forms a part of an electrical safety circuit and interrupts this circuit in the case of incorrect locking of the shaft door panels.

Such safety circuits, which in the case of high buildings can comprise a serial connection of more than twenty safety contacts, are known as one of the principal causes of disturbances in elevator operation. Due to corrosion and contamination the contact resistance of the individual safety contacts increases in a relatively short time, which in the case of serial connection of several contacts causes such a high voltage decay that the safety circuit system switches off the elevator even when the doors are correctly closed. Moreover, the investigation to find an individual defective safety contact or to find an incorrectly closed shaft door in a building with many floors is extremely time-consuming.

Additional problems with the monitoring of shaft doors have resulted in recent years from persons who enter the elevator shaft in unauthorized manner, whether it be to undertake highly risky "elevator surfing" or to block the elevator car between two floors and threaten or rob elevator passengers.

A shaft door monitoring system for a conventional elevator installation, which is to eliminate the above-described problems, is known from the U.S. Pat. No. 5,644,111. In this shaft door monitoring system, a contactlessly acting sensor in the form of a photoelectric detector with emitter and receiver is installed on each floor at the shaft wall opposite the shaft door. The light beam of the sensor is directed to the closing edge region of the closed shaft door panel and is reflected by the shaft door panel insofar as the shaft door panel is completely closed and the elevator car is not disposed between the sensor and the shaft door. If the shaft door panel is not completely closed and the elevator car is not in the region of the sensor, then the light beam exits into the elevator lobby from where it is no longer reflected in sufficient strength, so that the receiver of the photoelectric detector can register this state. A corresponding item of information is passed on to the elevator control, which stops the elevator and triggers suitable alarm signals (sirens, flashing light at the floor, etc.). If the elevator car is disposed at the floor with the unclosed shaft door, then the light beam of the sensor is reflected by the rear car wall so that the sensor correctly does not detect an impermissible state.

Such a shaft door monitoring system does indeed solve some of the afore-described problems, but has certain deficiencies.

The problem with the susceptibility of the safety circuit to disturbance is not eliminated by the disclosed solution, since such obviously exists unchanged and monitors, additionally to the photoelectric detectors, whether the shaft doors are closed and locked. Moreover, reliable functioning of the photoelectric detectors could be prejudiced by the fact that a person or an object disposed in front of the door gap of an incompletely closed shaft door reflects the light beam issuing into the elevator lobby and thus renders the monitoring system ineffective. In addition, a strong light source in the elevator lobby could impair reliable functioning of the sensor in the case of an incompletely closed shaft door. Further disadvantages result from the fact that a contact-free sensor has to be present at each floor. In the case of buildings with a large number of floors, an increased susceptibility to disturbance is inevitably caused by the correspondingly large number of sensors and the cost of periodic checking of the sensors is considerable. In addition, high costs arise for acquisition and installation of this multiplicity of sensors.

SUMMARY OF THE INVENTION

The present invention concerns an apparatus for operation.

The present invention has an object of creating a method for monitoring shaft doors of a elevator installation by which the stated prior art disadvantages can be avoided, i.e. in which, in particular, a safety circuit with a plurality of serially connected shaft door safety contacts is avoided, in which the number of monitoring sensors required is reduced and the efficiency of which cannot be influenced by persons or objects present in front of the shaft door or by the light conditions in the elevator lobby.

The method according to the present invention is accordingly based on the concept of eliminating the problems, which are known in conjunction with the previously usual multiplicity of sensors and/or contacts for the monitoring of shaft doors, by a method in which during the detection phases at least one beam in the form of focused electromagnetic waves and extending over several floors is emitted by an emitter of a shaft door monitoring sensor and is detected by a receiver, the beam being influenced in such a manner by a shaft door panel which is not completely closed and/or by a shaft door lock which is not disposed in locking setting that it is recognized by a receiver of the shaft door monitoring sensor that a shaft door is not completely closed and/or not locked, wherein this information is signaled by the shaft door monitoring sensor to the elevator control.

As detection phases there are designated those time segments in which, in the case of an operational sequence according to a program, all shaft doors must be closed and locked.

The monitoring of the locking state of the shaft door locks is preferably carried out in the manner that the beam is interrupted or reflected by screens which are associated with the shaft door locks and which project into the beam part when the respective door lock is not disposed in its locking setting.

The advantages achieved by the method according to the present invention are essentially to be seen in that the closed setting and the locked state of a large number of shaft doors can be contactlessly monitored by a single shaft door monitoring sensor. A significant cause for operational disturbances is thereby eliminated and at the same time the costs for acquisition, installation and later maintenance of a large number of monitoring sensors and/or monitoring contacts is substantially reduced. Moreover, in the case of this method the beam of the shaft door monitoring sensor is not able to be influenced in any situation by persons or objects disposed in front of the shaft door or by the light conditions in the elevator lobby.

According to an advantageous refinement of the method according to the present invention, a travelling elevator car is stopped by the elevator control and/or optical and/or acoustic alarm signals on at least one of the floors is or are activated if the shaft door monitoring sensor signals a shaft door panel which is not completely closed and/or a shaft door lock which is not disposed in locking setting during an operational state in which all shaft doors must be completely closed and locked. Stopping of the elevator car prevents a person from being injured, in the region of a shaft door which is not closed due to faulty functioning or due to unauthorized opening, by the moving elevator car. By alarm signals, such as flashing light and/or sirens, passengers are kept back from approaching an unclosed or unlocked shaft door so as to avert the risk of falling into the elevator shaft.

Any form of electromagnetic waves, by which a beam capable of being sufficiently focused over the requisite length can be produced and which can be so influenced by mechanical components connected with the shaft door panels and/or with the shaft door locks that a receiver can detect this influence, is in that case suitable as the beam for scanning the closed setting of the shaft door panels and the locking setting of the shaft door locks. Obviously excluded from use are electromagnetic waves which can pose a risk to life-forms or destroy materials.

Preferably, laser light beams or—for smaller beam lengths—infrared light barriers or infrared scanners come into consideration as the beam for the shaft door monitoring sensor. Laser light beams are, due to the coherence, i.e. the phase equality of the electromagnetic waves forming the light beam, capable of being focussed very well even in the case of large beam lengths, i.e. the increase in beam cross-sectional diameter with increasing beam length is very small. For buildings with a few floors, i.e. for shaft door monitoring sensors with a relatively short beam length, beams are also usable, in order to save costs, which are formed by incoherent infrared light.

With elevators having a large number of floors and consequently large shaft heights, the monitoring length required for monitoring all shaft doors can be divided up into several segments in all method variants described in the following, wherein each segment is monitored by at least one beam generated by a separate shaft door monitoring sensor with emitter and receiver.

Advantageously, shaft door monitoring sensors are used which emit light beams in the wavelength ranges of ultraviolet light, visible light or infrared light. Such sensors are available commercially and have the advantage that the beam path is visible by eye or is able to be checked by simple sensors.

According to a particularly simple embodiment of the method according to the present invention the beam is emitted by an emitter which is preferably arranged in the region of a shaft end (for example, in the shaft head) and received and evaluated by a receiver which is preferably arranged in the region of the other shaft end (for example, in the shaft pit). Such an arrangement, which is designated emitter/receiver principle in the following, has the shortest possible length of the beam path, which allows use of simpler and more economic beam systems, does not require complicated alignment of a reflection surface and minimizes sensitivity with respect to contamination. As already mentioned, the requisite monitoring length can also be achieved by arrangement of several segments in succession each with a respective emitter/receiver system.

According to a further embodiment of the present invention, the beam is emitted by an emitter, which is preferably mounted in the region of one shaft end, in the direction of a reflection surface, which is preferably mounted in the region of the opposite shaft end and from where the beam is reflected to a receiver present in the region of the emitter, wherein the receiver detects whether the beam reaches the receiver or is interrupted as a consequence of a shaft door panel which is not completely closed or a shaft door lock which is not disposed in locking setting. Advantageously, in the case of this method, which is termed reflection principle in the following, emitter and receiver are integrated in a single apparatus, which reduces production costs for the shaft door monitoring sensor and substantially simplifies installation in the shaft. In addition, in the case of this method variant the necessary monitoring lengths can be achieved by arrangement of several monitoring segments in succession each with a respective shaft door monitoring sensor according to the reflection principle.

A particularly advantageous development of the method according to the present invention consists in constructing the shaft door monitoring sensor as a distance measuring instrument, for example in the form of a laser distance measuring instrument. In that case the beam is emitted at least during the detection phases by an emitter, which is preferably mounted in the region of one shaft end, in the direction of a main reflection surface, which is preferably mounted in the region of the opposite shaft end, so that the beam is reflected by this main reflection surface or by a reflection surface, which is formed by a mechanical component connected with the associated shaft door panel or the shaft door lock and which protrudes into the beam when a shaft door panel is not completely closed and/or a shaft door lock is not disposed in locking setting, to a receiver present in the region of the emitter. Emitter and the receiver of the beam are constructed so that the distance covered by the beam on its path from the emitter back to the receiver by way of one of the reflection surfaces can be ascertained. This embodiment of the method has the advantage that it can not only be established whether one of the shaft door panels is not completely closed and/or one of the shaft door locks is not disposed in locking setting, but that it can also be ascertained on the basis of the measured distance where, i.e. at which floor, the source of disturbance is disposed. The division of the necessary monitoring length into several segments is also possible in the case of this method variant.

A particularly advantageous embodiment of the method according to the present invention is that the distance, which is measured during the detection phase, to an instantaneously effective reflection surface and/or an identification, which is ascertained therefrom, of the floor can be stored and/or displayed. A maintenance expert can immediately recognize, from the stored data or the display, the floor at which he or she has to look for a shaft door panel which is not completely closed or a shaft door lock which is not disposed in locking setting.

With advantage, the distance measurement is carried out in accordance with one of the following distance measuring methods able to be employed in the case of use of electromagnetic waves:

Measurement of the transit time of individual pulses of the electromagnetic wave forming the beam. This method known as "Time of Flight Measurement (TOF)" is based on the fact that individual electromagnetic pulses are emitted by an emitter and are detected—in the present application after reflection at a reflective surface—by a receiver. The "flight time" of the individual pulses is detected by means of an electronic circuit, from which, with consideration of the known speed of propagation of electromagnetic waves, a distance covered by the pulse can be calculated. The application of this principle is preferably carried out with laser light beams or—for smaller distances—with focused incoherent infrared light. TOF laser apparatus are suitable for use in the highest buildings, deliver measurement values with high resolution, are tried and tested many times and can be obtained commercially.

Measurement of the phase shift (Phase Shift Measurement) between emission and reception of a continuously emitted electromagnetic wave forming the beam. Preferably, in this measurement principle, lasers radiating coherent light are used as the beam generator. The detection of the distance covered by the beam between emitter and receiver—here via reflection surface—is based on the measurement of the shift in the phase position of the radiated sinusoidal wave on its path from the emitter to the receiver. The wavelength in that case must correspond with at least the distance to be measured. For relatively large distances, the measurement resolution in a given case is then too small. In this instance several waves of different wavelength are radiated, wherein that with the largest wavelength yields a relatively imprecise absolute value and that or those with the smaller wavelength or wavelengths enables or enable a higher resolution.

A development of the method according to the present invention, which is advantageous for certain arrangements of the shaft doors, is that several independent beams can be used for the shaft door monitoring. For example, the shaft door panel and the associated shaft door lock can thereby be monitored independently of one another or several mechanically intercoupled shaft door panels and/or shaft door locks of multi-panel shaft doors can be monitored independently of one another. Thus, on the one hand there results a redundancy of the shaft door monitoring which is desirable in terms of safety technology. On the other hand, distinction can be made between unclosed shaft door panels and unlocked shaft door locks, which makes it possible to react in optimum manner to difference disturbance reports. For example, in the case of detection of an unlocked shaft door lock with still locked shaft door, travel of the elevator car to the next stop can be continued instead of an immediate emergency braking, whereby trapping of passengers can be avoided.

An advantageous embodiment of the method according to the present invention is that the beam emitted by an emitter is so deflected on its path to the receiver at least once by means of a mirror or mirrors or an optical prism or prisms that it transits at least two vertical beam paths displaced relative to the shaft cross-section. The following advantages, for example, can thereby be achieved:

Two or more shaft door panels, which are arranged with a lateral offset, of several shaft doors arranged one above the other can be monitored by a single beam, i.e. by a single shaft door monitoring sensor.

The shaft door panels of several shaft doors arranged one above the other and screens, which are arranged offset relative to these in the shaft cross-section and are positioned depending on the locking state of associated shaft door locks, can be monitored by a single beam.

Initially all shaft door panels can be monitored with at least one vertical segment of the beam path, and all screens, which are positioned depending on the locking state of associated shaft door locks, can be monitored with at least one laterally offset further segment of the beam path produced by deflection, by a single beam of a shaft door monitoring sensor with distance measurement. If the beam is reflected by an incompletely closed shaft door panel and/or by one of the screens then due to the detected distance relative to the disturbing object it can be recognized whether at least all shaft door panels are closed which, as already described, enables differentiated control reactions to the signaled disturbance.

An interesting extension of the method according to the present invention with beam deflection is that the beam of a shaft door monitoring sensor equipped for distance measurement is guided, after it has transited the shaft door monitoring regions, by a further beam deflecting device in vertical direction to a reflection surface mounted at the elevator car, from where the beam is reflected to the receiver of the shaft door monitoring sensor. In this manner continuous information about the position of the elevator car within its shaft path can additionally be generated and can serve, for example, in a comparison circuit, for increase in reliability relative to faulty functioning of a main car position detecting system.

According to a further refinement of the method according to the present invention, remotely controlled auxiliary locks acting on the shaft doors can be activated—preferably by the elevator control—if the shaft door monitoring sensor signals a shaft door panel which is not completely closed and/or a shaft door lock which is not disposed in the locking setting during an operational state in which all shaft doors should be closed. Safety against the fall of a person and, in particular, against entry of an unauthorized person into the elevator shaft can be substantially increased by such a device. As soon as one of the shaft doors is detected as being not completely closed, an activation of the auxiliary locks takes place before the unlocked shaft door is opened to such an extent that a person can go through.

A further embodiment, which is of particular interest in terms of safety engineering, of the method according to the present invention can be achieved with an elevator installation which is equipped with a shaft door monitoring sensor with distance measurement. In that case optical and/or acoustic alarm signals and/or remotely controllable auxiliary locks acting on the shaft door panels can be activated exclusively at that floor at the shaft doors of which a shaft door panel which is not completely closed and/or a shaft door lock which is not disposed in locking setting is or are detected during an operational state in which all shaft doors should be closed and locked. Such a system has the advantage that alarm devices are observed only at the floor concerned, so that persons at the other floors are not unnecessarily disturbed. Auxiliary locks for the shaft door panels similarly act only at the floor concerned, so that in the case of a elevator car possibly at standstill between two floors the maintenance personnel can gain access to the elevator shaft without problems by way of another shaft door which is not additionally locked.

DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 9 is a side elevation view of the group of shaft doors shown in FIG. 8.

DESCRIPTION OF THE PREFERRED EMBODIMENT

Figure 1:
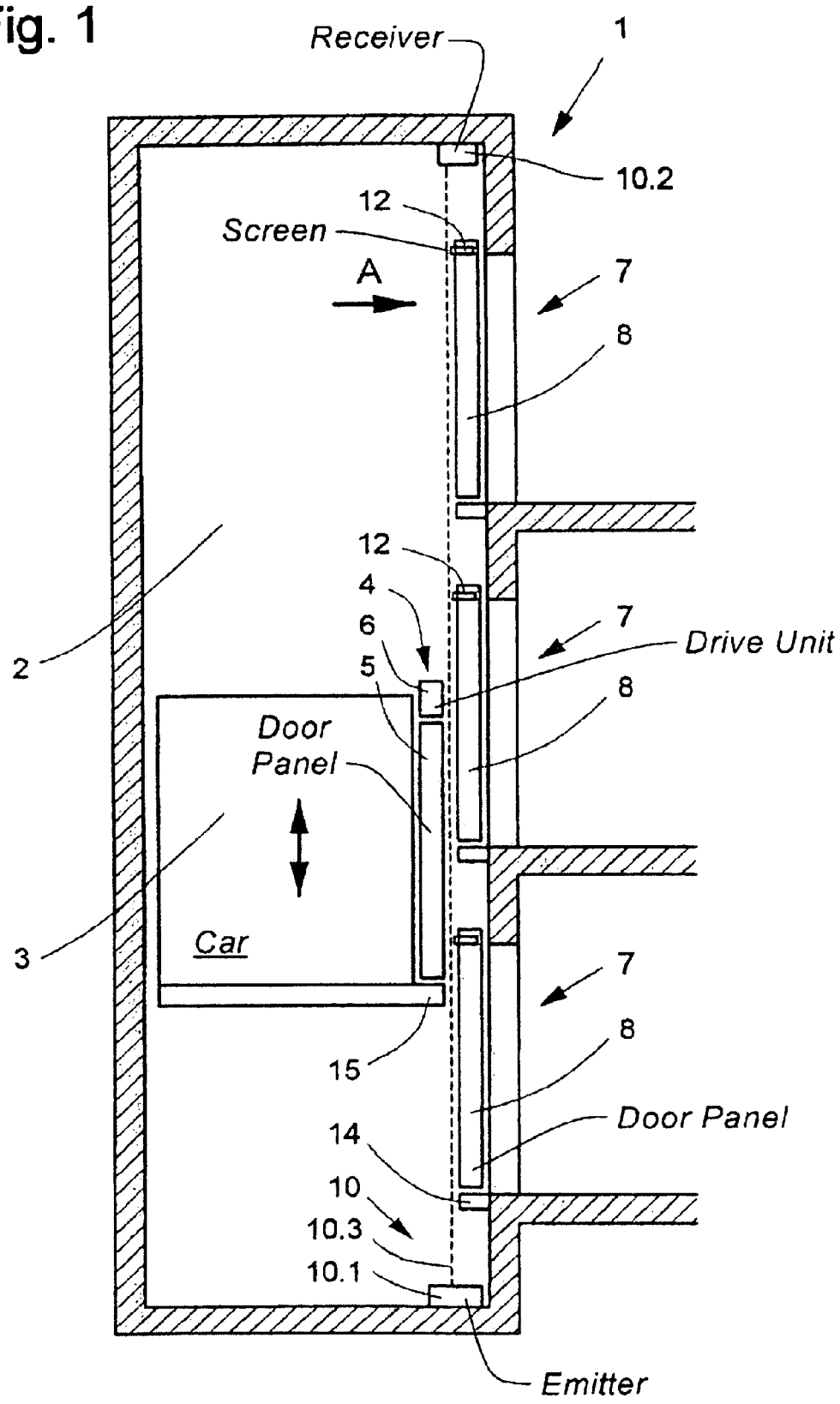
FIG. 1 is a schematic vertical section through a elevator shaft with a elevator car and several shaft doors, wherein the shaft doors are monitored by a beam emitted by an emitter to a receiver in accordance with the present invention.

An elevator installation 1 with an elevator shaft 2 and an elevator car 3 is illustrated schematically in FIG. 1. The elevator car 3 is equipped with a car door 4, which has two car door panels 5 which, for opening and closing, are horizontally displaced by a door drive unit 6 mounted at the elevator car. The elevator shaft 2 includes three shaft doors 7, which each have two shaft door panels 8. The opening and closing of the shaft door 7 is effected by horizontal movement of the shaft door panels 8 thereof when the elevator car 3 is disposed at the corresponding floor, wherein the drive force for this horizontal movement is transmitted by means of a door actuating mechanism from the car door panels 5 to the shaft door panels 8.

In the closed state, the shaft door panels 8 are locked by means of a shaft door lock—not shown here—with a stationary part of the shaft doors. An emitter installed in the region of the shaft pit and near the shaft wall containing the shaft doors is denoted by 10.1. This emitter 10.1 emits—at least during a detection phase—a beam 10.3 in the form of focused electromagnetic waves, preferably a laser light beam. The beam 10.3 emitted by the emitter 10.1 is oriented towards a receiver 10.2 which is fixed in the region of the shaft head and which receives the beam 10.3 insofar as this is not interrupted in consequence of a shaft door panel 8 which is not completely closed and/or a shaft door lock which is not disposed in the locking setting. The emitter 10.1 and the receiver 10.2 together form the shaft door monitoring sensor 10. The arrangement described here is designated emitter/receiver principle in the following. If the beam 10.3 during the detection phase is interrupted, then the shaft door monitoring sensor signals to the elevator control that one of the shaft door panels 8 is not completely closed or that one of the shaft door locks is not disposed in the locking setting. Designated as detection phases are those time segments in which, in the case of an operating sequence according to program, all shaft doors must be closed and locked.

In the illustrated version, the beam 10.3 extends in a vertical plane which lies between the shaft doors 7 and the car doors 4 and which is defined by the gap between a shaft door threshold 14 and a car door threshold 15. Since the beam in the case of this embodiment of the method extends in vertical direction between the shaft doors and the car door, it is of advantage if the beam emission takes place only during the detection phase so that passengers are not irritated by the beam, which is possibly visible. The beam 10.3 is influenced by screens 12 which are associated with each of the shaft doors 7 and which are so disposed in connection with the shaft door panels and the shaft door locks that they interrupt the beam 10.3 if the shaft door 7 is not completely closed and/or a shaft door lock is not disposed in the locking position, as is illustrated in more detail in FIG. 2.

Figure 2:
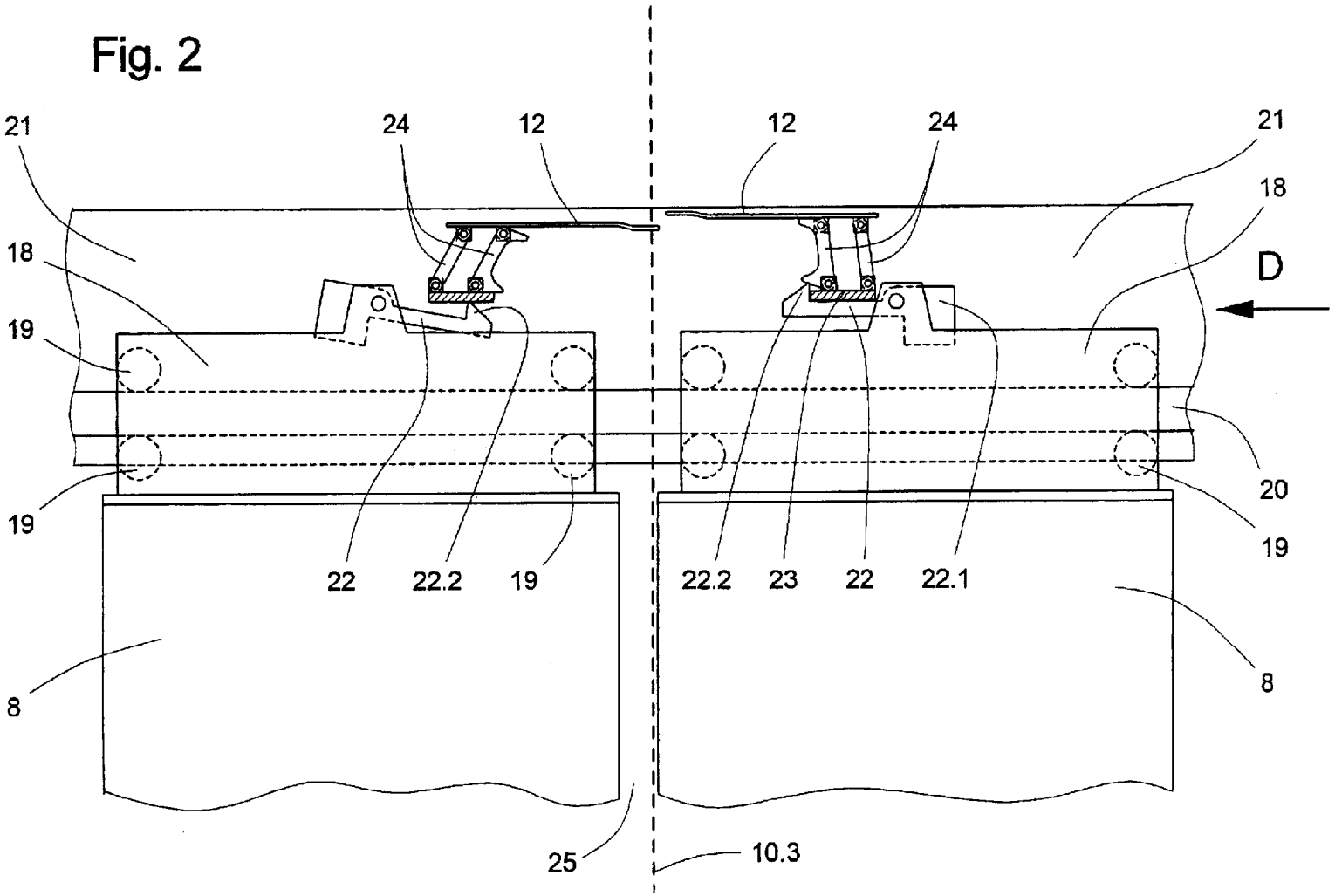
FIG. 2 is fragmentary schematic elevation view of a two-panel elevator shaft door, seen from the shaft interior, with two locking devices and one monitoring beam.

FIG. 2 illustrates (to enlarged scale and schematically) a view in a direction A, which is identified in FIG. 1, of the upper region of one of the shaft doors 7 in FIG. 1. This shaft door has two shaft door panels 8 which are each fastened to a respective door panel carrier 18. These door panel carriers 18 are guided by means of guide rollers 19 at a guide rail 20 to be horizontally displaceable, wherein the guide rail 20 is fastened to a door support 21 connected with the door frame. The beam, which is described in connection with FIG. 1, of the shaft door monitoring sensor 10 is denoted by 10.3. A respective shaft door lock 22 is pivotably mounted at each of the two door panel carriers 18.

On the right-and side of FIG. 2 it is illustrated how the shaft door lock 22 locks the door panel carrier 18 with a locking abutment 23, which is immovably connected with the door support 21, when the shaft door panel 8 is completely closed. During the opening and closing of the shaft door panel 8 the shaft door lock 22 is kept, in a manner which is not illustrated here, in unlocked setting by the door actuating mechanism acting from the elevator car. As soon as the car door and the shaft door are closed, this action is cancelled and the shaft door lock 22 tips as a consequence of its closing weight 22.1 into its locking setting. In that case a locking hook 22.2 of the shaft door lock so acts on two swivel arms 24, which are mounted on the non-movable locking abutment and carry one of the screens 12, that these pivot out of their basic setting—illustrated on the left—to the right which causes a displacement of the screen 12 to the right and thus out of the beam path of the beam 10.3.

On the left-and side of FIG. 2 there is illustrated a shaft door panel 8 which is not completely closed (door gap 25) and the shaft door lock 22 of which consequently—possibly for another reason—is not disposed in its locking setting. Since in this situation the locking hooks 22.2 of the shaft door lock 22 do not act on the swivel arms 24 carrying the screen 12, the screen remains in its basic setting which results, without external action, by itself from the swivel arm arrangement and in which it interrupts the beam path of the beam 10.3.

The afore-described method thus enables monitoring of the closed state and the locking state of a plurality of centrally or laterally closing single-panel, two-panel or multi-panel shaft doors with the help of a single beam.

Figure 5:
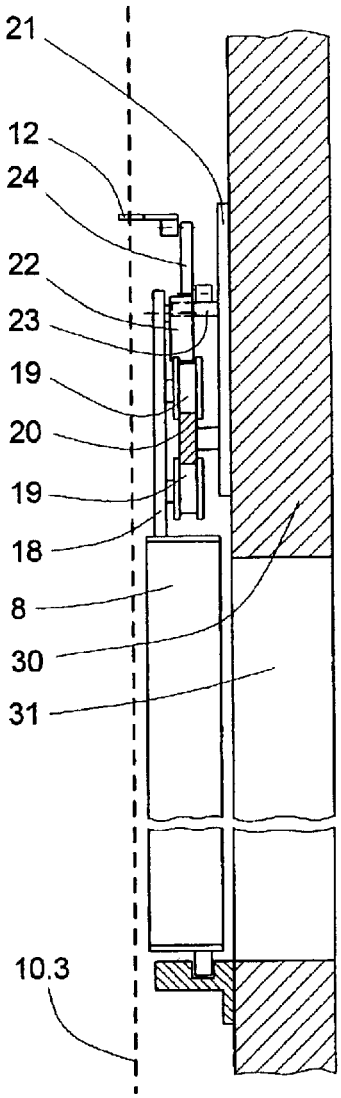
FIGS. 5, 6 and 7 are fragmentary side elevation views of the shaft doors, which are illustrated in FIG. 2 and FIG. 4, showing the position of the monitoring beams.

A side view in a direction D, shown in FIG. 2, of the described shaft door arrangement, from which also the position of the beam 10.3 is evident, is illustrated in FIG. 5.

Figure 3:
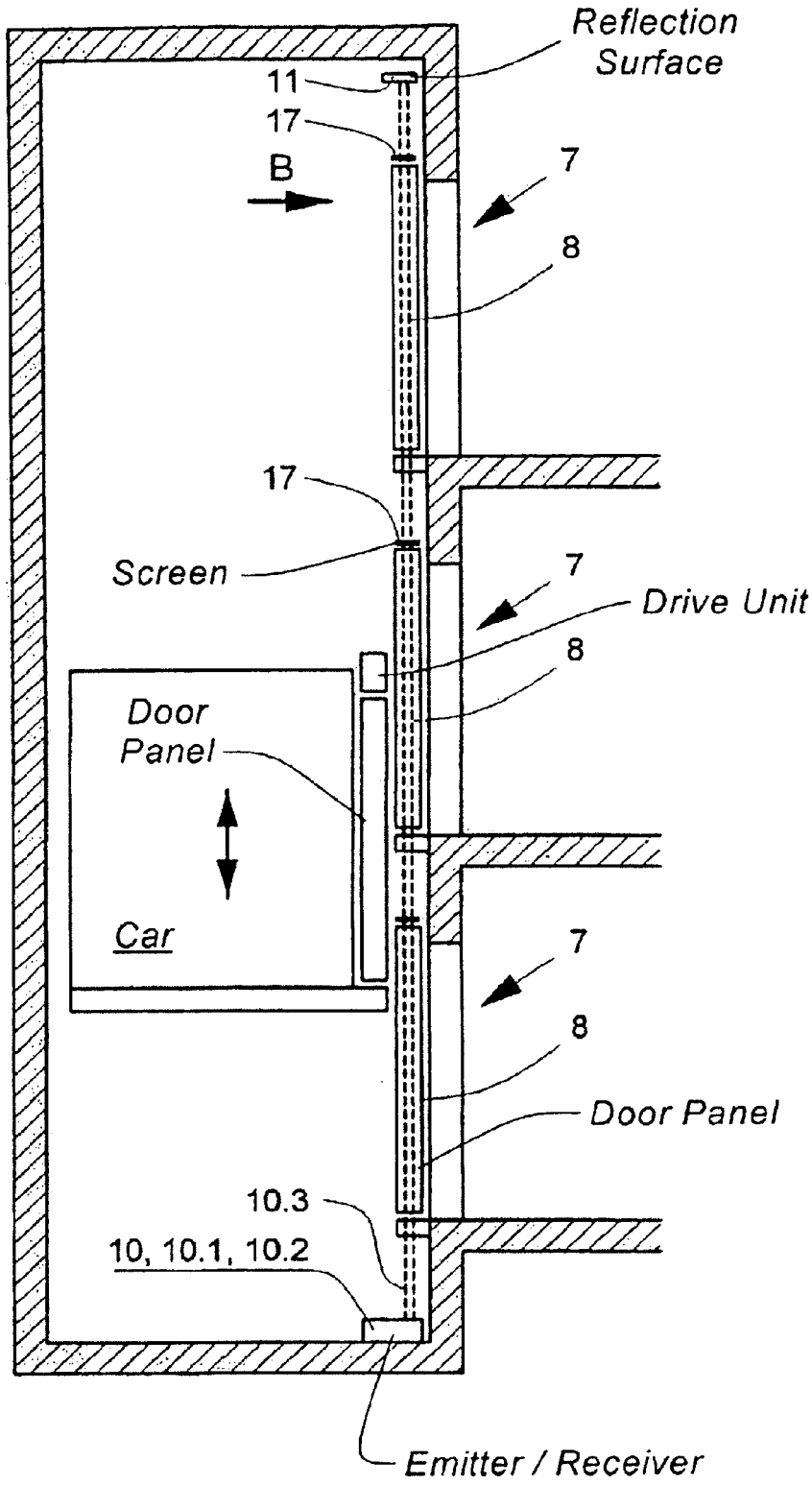
FIG. 3 is a view similar to FIG. 1 wherein the shaft doors are monitored by a beam that is emitted by an emitter to a reflection surface and reflected to a receiver in accordance with the present invention.

FIG. 3 in turn shows a elevator installation with a shaft door monitoring sensor 10 which monitors the setting of the shaft door panels 8 and the shaft door locks thereof with the help of at least one beam 10.3 formed by electromagnetic waves able to focused, preferably a laser light beam. In the case of this shaft door monitoring sensor, however, emitter 10.1 and receiver 10.2 are arranged in the same shaft end region, preferably in the same housing, and the beam 10.3 emitted by the emitter 10.1 is directed towards a reflection surface 11 which is mounted in the region of the opposite shaft end and which reflects the beam 10.3 to the emitter 10.1 insofar as the beam is not interrupted in consequence of a shaft door panel 8 which is not completely closed and/or a shaft door lock which is not disposed in locking setting.

The afore-described arrangement of emitter, receiver and reflection surface is designated reflection principle in the following. Emitted and reflected beams in that case lie closely adjacent to one another so that the sensor characteristics of shaft door monitoring sensors according to the reflection principle substantially correspond with those of shaft door monitoring sensors according to the emitter/receiver principle. In the subsequent drawings, therefore, distinction between the two principles is no longer made and in each instance only one beam is shown.

In the arrangement version, which is shown in FIG. 3, of the shaft door monitoring sensor 10 at least one laser light beam 10.3 so extends along the shaft wall containing the shaft doors 7 that it is interrupted by an incompletely closed shaft door panel 8 and/or by one of the screens 17, which project into the beam 10.3 when they are not prevented from that by the respectively associated shaft door lock disposed in locking setting. Details for the arrangement of these screens—here illustrated only schematically—are explained below with respect to FIG. 4.

Figure 4:
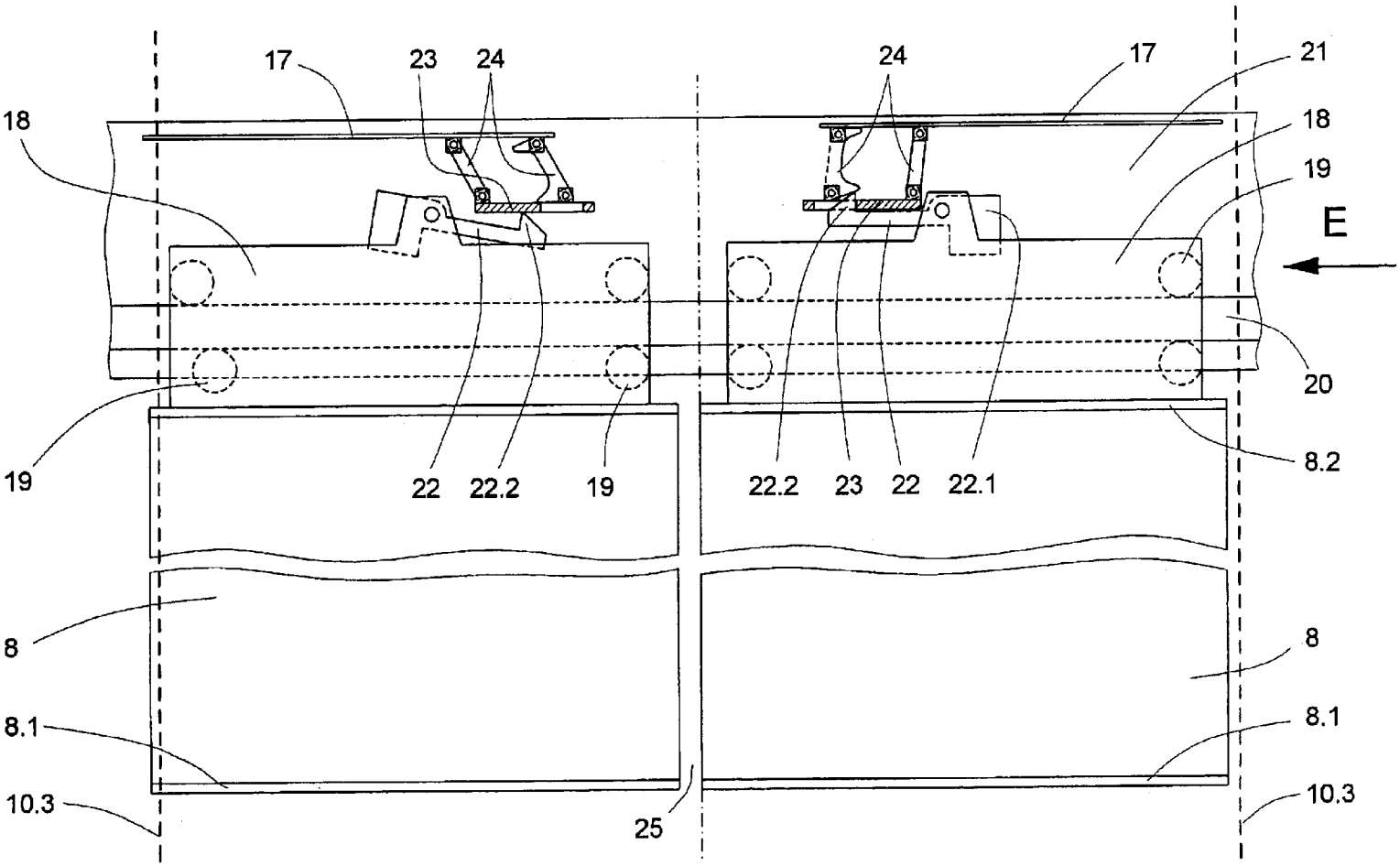
FIG. 4 is a view similar to FIG. 2 of a two-panel shaft door, seen from the shaft interior, with two locking devices and two monitoring beams.

FIG. 4 shows (to enlarged scale) the view, which is identified by B in FIG. 3, of the upper region of one of the shaft doors 7 illustrated in FIG. 3. This shaft door similarly has two shaft door panels 8 which are each fastened to the respective door panel carrier 18. These door panel carriers 18 are guided by means of the guide rollers 19 at the guide rail 20 to be horizontally displaceable, wherein the guide rail 20 is fastened to the door support 21 connected with the door frame. To the left and the right of the two shaft door panels 8 there is recognizable the respective beam 10.3—preferably a laser light beam—as already explained in connection with FIG. 1 and FIG. 3. The two beams are each emitted and detected by the respective shaft door monitoring sensor 10, the sensors being installed for monitoring the row of shaft door panels in the elevator shaft respectively at the left-hand side and at the right-hand side. The single path beam principle, in which emitter and receiver are arranged at a spacing from one another, and also the reflection principle, as described in connection with FIG. 3, are usable.

Here, too, the respective shaft door lock 22 is pivotably mounted at each of the two door panel carriers 18. It can be recognized on the right-hand side of FIG. 4 how the shaft door lock 22 locks the door panel carrier 18 with the locking abutment 23, which is immovably connected with the door support 21, when the shaft door panel 8 is completely closed. During opening and closing of the shaft door panel 8 the shaft door lock 22 is held by the door actuating mechanism, which acts from the elevator car, in unlocked setting in a manner which is not illustrated here. As soon as the car door and the shaft door are closed, this action is cancelled and the shaft door lock tips into its locking setting as a consequence of its closing weight 22.1, shown here on the right-hand side. In that case the locking hook 22.2 of the shaft door lock so acts on the two swivel arms 24, which are mounted on the immovable locking abutment 23 and carry one of the screens 17, that these are pivoted to the left out of their basic setting—recognizable on the left-hand side—which causes a displacement of the screen to the left and thus out of the beam path of the beam 10.3.

Figure 6:
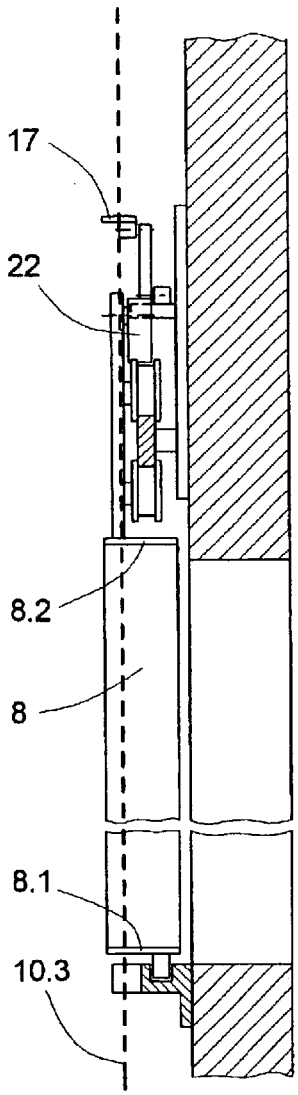

The left-hand side of FIG. 4 in turn shows one of the shaft door panels 8 that is not completely closed (door gap 25) and the shaft door lock 22 of which accordingly not disposed—possibly for another reason—in its locking setting. Since in this situation the locking hook 22.2 of the shaft door lock 22 does not act on the swivel arms 24 carrying the screen 17, the screen 17 remains in its basic setting which results, without external action, by itself from the swivel arm arrangement and in which it interrupts the beam path of the beam 10.3. The automatic adoption of the screen basic setting, in which the beam 10.3 is interrupted, could in addition be secured by a suitably mounted spring. A side view E of the afore-described shaft door arrangement according to FIG. 4, from which the position of the beams 10.3 is also evident, is illustrated in FIG. 6.

The foregoing method described in connection with FIG. 4 has the advantage that a beam does not, as in the arrangement according to FIGS. 1 and 2, have to propagate within the relatively narrow gap between the shaft door threshold and the car door threshold, but the space laterally adjacent to the shaft doors is used for that purpose. The emission of the beam here should not be interrupted during the door opening phase. Moreover, this method brings an increased reliability in the shaft door monitoring, since on the one hand an incompletely closed shaft door panel directly interrupts the beam and on the other hand a certain degree of safety redundancy results from the separate monitoring of the left-hand and right-hand shaft door panel, even if the movements thereof are not mechanically synchronized in each case.

FIG. 5 shows a side view of the shaft door arrangement according to FIG. 2 (view D) in which the closed setting of the shaft door panels 8 and also the locking state of the shaft door lock 22 are monitored by a single beam 10.3, wherein the vertical gap 25 extends approximately in the center of the door openings and in the gap between the shaft door thresholds and the car door threshold.

The following components can be recognized in FIG. 5:

- a shaft wall 30, which contains the shaft doors 7, with the door opening,
- the door support 21, which is fixed to the shaft wall, with the guide rail 20 fastened thereto,
- the door panel carrier 18 which carries the shaft door panels 8 and which is guided at the guide rail 20 by means of the guide rollers 19 mounted thereon,
- the shaft door lock 22 which is pivotably mounted at the door panel carrier 18 and which locks the door panel carrier 18 with the locking abutment 23, and
- the swivel arms 24 which are moved by the shaft door lock 22 and which move the screen 12 into or out of the beam path of the central beam 10.3 depending on the setting of the shaft door lock 22.

FIG. 6 shows a side view of the shaft door arrangement according to FIG. 4 (view E) in which the closed setting of each shaft door panel 8 is monitored jointly with the locking state of its shaft door lock 22 by the beam 10.3. In that case the vertical beam 10.3 extends so closely behind the narrow side, which is opposite the closing edge, of the closed shaft door panel 8 that it is interrupted, in the case of an incompletely closed shaft door panel 8, by a lower edge 8.1 thereof or an upper edge 8.2 thereof and/or by the screen 17 not retracted by the shaft door lock 22. The components, which are illustrated in FIG. 6, of the shaft doors correspond, with the exception of these differently arranged screens 17, with the components explained in connection with FIGS. 4 and 5.

Figure 7:
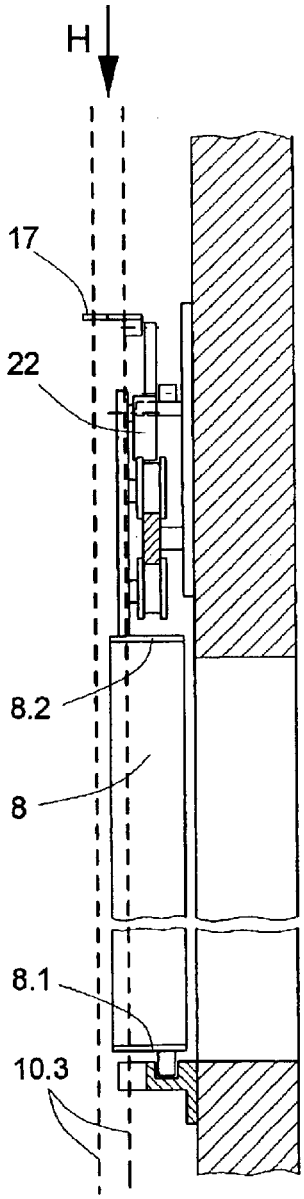
Figure 7:
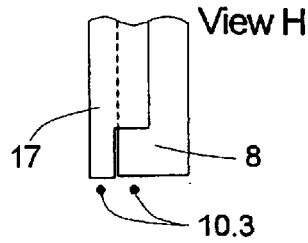

FIG. 7 shows the side view of a variant of the shaft door monitoring system with improved functionality. Such is achieved by the fact that the closed setting of the shaft door panels arranged one above the other in the elevator shaft and the locking state of the shaft door locks 22 associated with the shaft door panels 8 are separately monitored. Such a monitoring can be realized in that, for example, each of the two individual beams 10.3 shown in FIG. 4 are replaced by two parallel beams 10.3 (FIG. 7), which are offset relative to one another in the direction of the plane of the drawing and of which one monitors the lower edge 8.1 or the upper edge 8.2 of the associated shaft door panel 8 and the other the screen 17 arranged somewhat laterally of the shaft door panel 8 (corresponding with the screen 17 in FIG. 4). The two parallel beams 10.3 are in that case produced by two separate shaft door monitoring sensors, wherein the emitter/receiver principle or the reflection principle can come into use.

Another possibility of realization of the stated separate monitoring results from the fact that the locking state of the shaft door locks 22, as illustrated in FIG. 2, is monitored by the central beam 10.3 detecting one of the two screens 12 and the closed state of the shaft door panels is monitored by two beams 10.3 arranged in correspondence with FIG. 4. The side view shown in FIG. 7 is also applicable to this possibility of realization.

The advantages of the separate monitoring of the closed state and locking state are to be seen in the fact that different reactions to a detected fault state can be derived therefrom. For example, the moving elevator car can, on occurrence of a locking fault, still move on to the next floor, whereas in the case of detection of an opened shaft door an emergency stop is generated. However, if, for example, two beams monitoring the locks and a beam monitoring the closed setting of all shaft door panels on the left-hand side signal correct states, whilst an unclosed state is reported for the shaft door panel on the right-hand side, it could be concluded therefrom that in the case of the shaft door reported as not closed a detection error must be present and that travel to the next destination floor can be continued. Respectively adapted reactions can be programmed for a plurality of different signal combinations.

Particularly efficient reactions to fault signals can be derived if, as described in the following, the position of the components causing the fault signals can additionally be detected. It can be recognized without difficulty from the previous descriptions and FIGS. 1 to 7 that through use of shaft door monitoring sensors constructed for distance measurement the distance between a shaft door monitoring system and a shaft door panel which is not completely closed or a screen associated with a shaft door lock which is not disposed in locking setting can be detected. The beam emitted by an emitter of a shaft door monitoring sensor is in that case not simply interrupted by the screens and/or the lower or upper edges of the shaft door panels, but reflected to a receiver. Screens and lower or upper edges are for this purpose equipped at suitable locations with reflectors or coated with reflective material. In that case the shaft door monitoring sensor can, for example due to the transit time of individual light pulses or the phase position of the laser light detected at the receiver, ascertain the distance covered by the beam. The elevator control can determine from the measured distance the floor at which a fault state exists and store this information on behalf of maintenance personnel, transmit it to a maintenance center and/or utilize it to activate an optical or acoustic alarm signal in the region of the shaft door concerned. In the case of a shaft door panel which is closed, but not correctly locked, it is also possible to start a program in which, after all passengers have left the elevator car, the elevator car is moved in creeping motion to the fault-affected floor where it is sought, by opening and closing car and shaft doors, to eliminate the locking fault.

Figure 8:
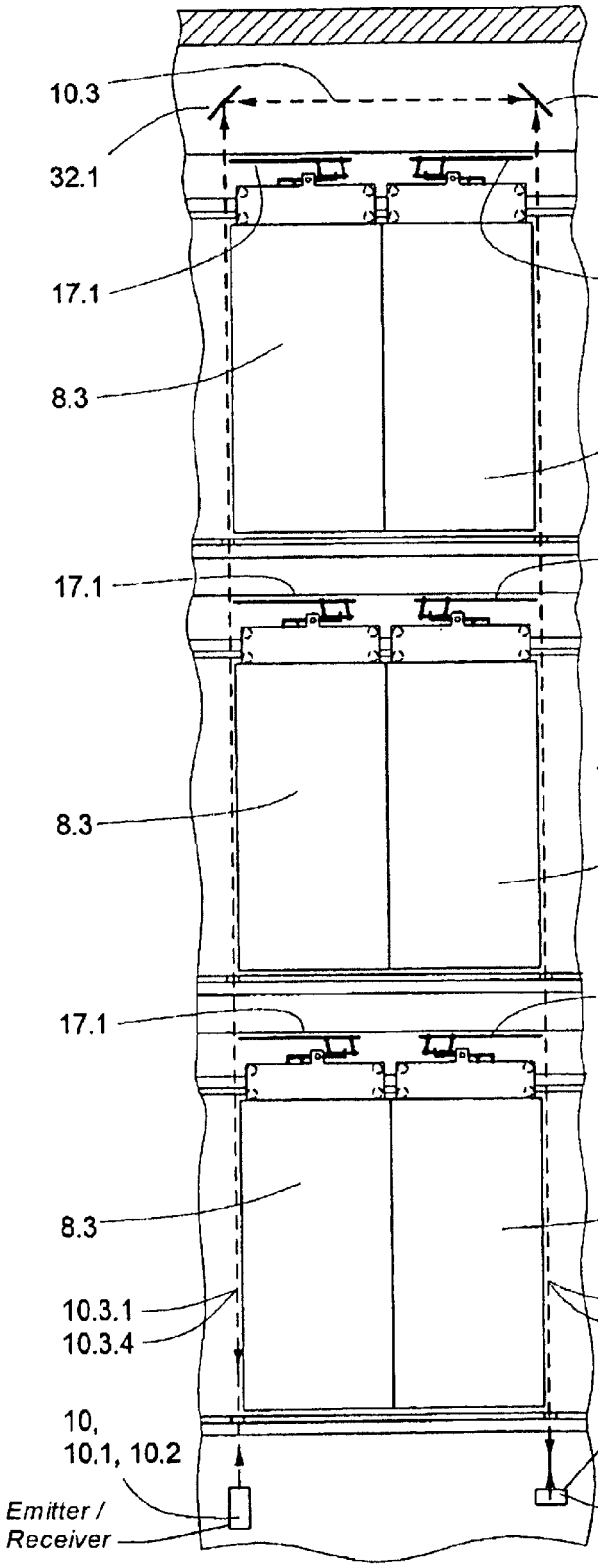
FIG. 8 is an elevation view from the shaft interior of a group of shaft doors, the closed state and locking of which are monitored by means of a deflected beam.
Figure 8:
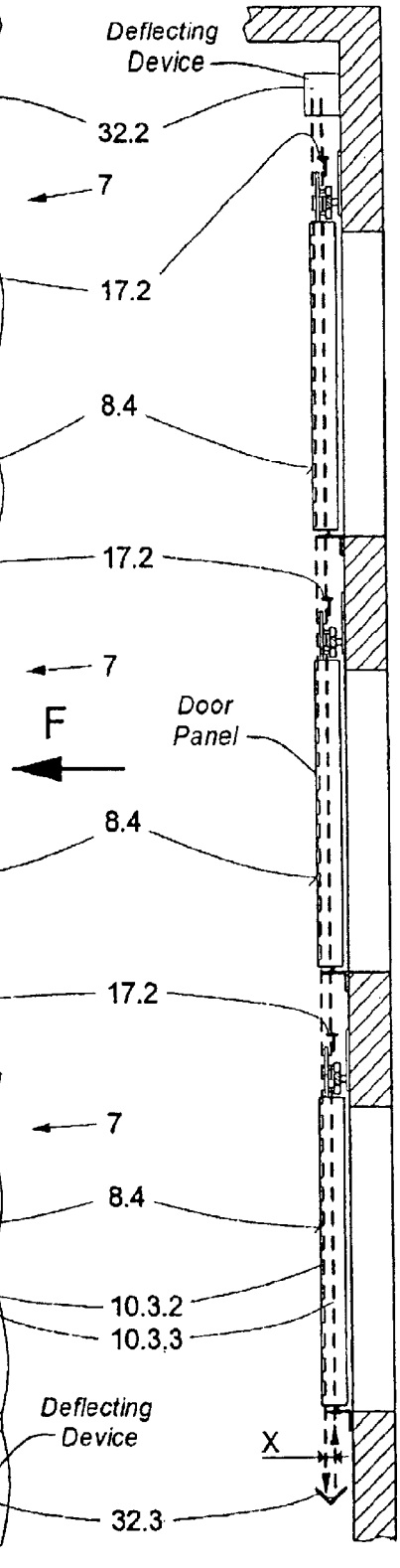

FIG. 8 and FIG. 9 schematically show a group of shaft doors which are arranged one above the other and the closed state and locking state of which are monitored by means of a multiply deflected beams 10.3. FIG. 9 in that case illustrates a view F, from the right, on the stated group of shaft doors.

As recognizable in FIG. 8, the beam 10.3 is emitted vertically upwardly by an emitter 10.1, which is arranged below a lowermost shaft door of the group, of a shaft door monitoring sensor 10 laterally adjacent to the shaft door panels 8.3 of the left-hand side. After running through a first vertical segment 10.3.1 of its beam path it is deflected above the uppermost shaft door of the monitored group by a first beam deflecting device 32.1 to the right towards a second beam deflecting device 32.2. By this the beam is redeflected by 90° so that this runs, laterally adjacent to shaft door panels 8.4 at the right-hand side, through a second vertical segment 10.3.2 in downward direction and is incident on a third beam deflecting device 32.3. This deflects the beam 10.3 through 180°, wherein at the same time a displacement of the beam through a specific distance X in direction towards the shaft wall is to be carried out, as is recognizable in FIG. 9. Subsequently, the beam runs in a third vertical section 10.3.3 back up to the beam deflecting device 32.2, which diverts it through 90° to the left (in FIG. 8) relative to the beam deflection direction 32.1. Here the beam is diverted a final time through 90°, whereafter it covers a fourth vertical segment 10.3.4 and is finally detected by the receiver 10.2 of the shaft door monitoring sensor 10. In the region of its vertical segments the beam can be influenced by incompletely closed shaft door panels or by the screens 17 which are not retracted by their associated shaft door locks. Shaft door panels 8.3 at the left-hand side can influence the vertical segment 10.3.1 of the beam 10.3 and the shaft door panels 8.4 at the right-hand side can influence the vertical segment 10.3.2 of the beam 10.3. Screens 17.1 at the left-hand side can influence the vertical segment 10.3.4 of the beam 10.3 and screens 17.2 at the right-hand side can influence the vertical segment 10.3.3 of the beam 10.3.

Mirrors and/or suitable optical prisms can be used as beam deflecting devices 32.1, 32.2 and 32.3.

If the shaft door monitoring sensor 10 with distance measurement is used for monitoring the shaft doors, then in the case of disturbance it can be recognized by the described method with the beam course initially detecting the shaft door panels whether one of the shaft door panels 8.3, 8.4 is not completely closed whether only one of the shaft door locks determining the setting of the screens 17.1, 17.2 is not disposed in its locking setting. Due to this distinction, the already mentioned situation-adapted reactions can be triggered even in the case of this shaft door monitoring equipment having only a single beam.

Obviously all afore-described methods can also be rationally employed on shaft doors with only one shaft door panel or with more than two shaft door panels.

The mode and manner in which the action of the shaft door setting and/or the shaft door lock setting on the beams is realized can vary almost without limits. For example, the shaft door lock setting can be transmitted directly or by way of couplings and linkages to the position of screens or reflective surfaces in the form of flaps, slides, etc., so that these can influence the beams extending in suitable zones in the vicinity of the shaft doors.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of monitoring shaft doors of a elevator installation with a elevator shaft and a elevator car vertically movable along one shaft wall, wherein the shaft wall has several shaft doors each with at least one horizontally displaceable shaft door panel, wherein when the elevator car stops at a floor at least one shaft door panel of the shaft door respectively opposite the elevator car is opened and closed by a corresponding car door panel, wherein the elevator installation includes an elevator control by which the movements of the elevator car, the car door panel and thus the respectively corresponding shaft door panel are controlled, and wherein a closed setting of the shaft door panel is monitored by at least one contactlessly-acting shall door monitoring sensor emitting electromagnetic waves, comprising the steps of:

a. emitting from an emitter at least during specific detection phases a beam in the form of eleotromagnetic waves, the beam extending along a generally straight line path over several floors in the elevator shaft;

b. detecting the beam with a receiver arranged so that when one of the shaft door panels is not completely closed and/or a shaft door lock is not disposed in locking state the beam is influenced in such a manner that it is recognized by the receiver that the one of the shaft doors is not completely closed and/or not locked; and c. generating a disturbance signal from the shaft door monitoring sensor to the elevator control in response to the influenced beam.

2. The method according to claim 1 including a step of responding to the disturbance signal by stopping the elevator car when in motion and/or activating at least one of optical and acoustic alarm signals on at least one of the floors.

3. The method according to claim 1 wherein said step a. is performed by emitting a focussed beam of incoherent light waves or a laser light beam of coherent light waves.

4. The method according to claim 3 wherein the beam is formed of light in wavelength ranges of ultraviolet light, visible light or infrared light.

5. The method according to claim 1 including mounting a receiver a., distance of several floors from an emitter, operating the emitter to perform said step a performing said step b. by determining whether the beam reaches the receiver or is interrupted as a consequence of a shaft door panel which is not completely closed or a shaft door lock which is not disposed in a locking state.

6. The method according to claim 1 including operating the emitter to emit the beam only during a detection period of operation of the elevator installation.

7. The method according to claim 1 including providing a reflection surface mounted several floors from the emitter and the receiver and oriented so that the beam arriving from the emitter is reflected to the receiver.

8. The method according to claim 7 wherein the reflection surface is a main reflection surface and including ascertaining a reference distance covered by the beam on its path from the emitter by way of the main reflection surface and back to the receiver.

9. The method according to claim 8 including ascertaining a current distance covered by the beam between the emitter and the receiver, comparing the current distance with the reference distance and performing said step c. when the current distance is shorter than the reference distance.

10. The method according to claim 8 where the current distance is ascertained by one of measurement of the transit time of individual pulses of the electromagnetic wave forming the beam and measurement of the shift, which occurs between emission and reception, of the phase position of the coherently emitted electromagnetic waves forming the beam.

11. The method according to claim 1 including performing said steps a. through c. independently for each shaft door panel and each shaft door lock associated with the elevator installation.

12. The method according to claim 1 including reflecting the beam to define at least two spaced apart vertical paths in the elevator shaft between the emitter and the receiver.

13. The method according to claim 1 including activating remotely controllable auxiliary locks acting on the shaft door panels in response to the disturbance signal when the beam is influenced by an incompletely closed shaft door panel during an operational state in which all shaft doors should be closed.

14. The method according to claim 1 including activating at least one of an optical alarm signal, an acoustic alarm signal and a remotely controllable auxiliary lock acting on the shaft door panel at a floor in response to the disturbance signal when the beam is influenced at that floor.

15. A method of monitoring shaft doors of a elevator installation with a elevator shaft and a elevator car vertically movable along one shaft wall, wherein the shaft wall has several shaft doors each with at least one horizontally displaceable shaft door panel, wherein when the elevator car stops at a floor at least one shaft door panel of the shaft door respectively opposite the elevator car is opened and closed by a corresponding car door panel, wherein the elevator installation includes in elevator control by which the movements of the elevator car, the car door panel and thus the respectively corresponding shaft door panel are controlled, and wherein a closed setting of the shaft door panel is monitored by at least one contactlessly-acting shaft door monitoring sensor emitting electromagnetic waves, comprising the steps of:

a. emitting from an emitter at least during specific detection phases a beam in the form of electromagnetic waves and extending from several floors in the elevator shaft;

b. detecting the beams with a receiver arranged so that when one of the shaft door panels is not completely closed and/or a shaft door lock is not disposed in locking state the beam is influenced in such a manner that it is recognized by the receiver that the one of the shaft doors is not completely closed and/or not locked;

c. providing a reflection surface mounted several floors from the emitter and the receiver, and oriented so that the beam arriving from the emitter is reflected to the receiver, and wherein the reflection surface is a main reflection surface;

d. ascertaining a reference distance covered by the beam on its path from the emitter by way of the main reflection surface and back to the receiever; and e. generating a disturbance signal from the shaft door monitoring sensor to the elevator control in response to the influenced beam.

16. The method according to claim 15 including ascertaining a current distance covered by the beam between the emitter and the receiver, comparing the current distance with the reference distance and performing said step e. when the current distance is shorter than the reference distance.

17. The method according to claim 15 where the current distance is ascertained by one of measurement of the transit time of individual pulses of the electromagnetic wave forming the beam and measurement of the shift, which occurs between emission and reception, of the phase position of the coherently emitted electromagnetic waves forming the beam.

18. A method of monitoring shaft doors of a elevator installation with a elevator shaft and a elevator car vertically movable along one shaft wall, wherein the shaft wall has several shaft doors each with at least one horizontally displeceable shaft door panel, wherein when the elevator car stops at a floor at least one shift door panel of the shaft door respectively opposite the elevator car is opened and closed by a corresponding car door panel, wherein the elevator installation includes an elevator control by which the movements of the elevator car, the car door panel and thus the respectively corresponding shaft door panel are controlled, and wherein a closed setting of the shaft door panel is monitored by at least one contactlessly-acting shaft door monitoring sensor emitting electromagnetic waves, comprising the steps of:

a. emitting from an emitter at least during specific detection phases a beam in the form of electromagnetic waves, the beam being propagated in a generally vertical plane over several floors in the elevator shaft;

b. detecting the beam with a receiver arranged so that when one of the shaft door panels is not completely closed and/or a shaft door lock is not disposed in locking state the beam is influenced in such a manner that it is recognized by the receiver that the one of the shaft doors is not completely closed and/or not locked; and c. generating a disturbance signal from the shaft door monitoring sensor to the elevator control in response to the influenced beam.

* * * * *